United States Patent [19]

Caldwell et al.

[11] 4,053,663

[45] Oct. 11, 1977

[54] METHOD OF TREATING FERROUS STRAND FOR COATING WITH ALUMINUM-ZINC ALLOYS

[75] Inventors: Laurence B. Caldwell; Robert W. Helman, both of Bethlehem, Pa.; Leonard P. Pellatiro, Glen Arm, Md.

[73] Assignee: Bethlehem Steel Corporation, Bethlehem, Pa.

[21] Appl. No.: 690,749

[22] Filed: May 27, 1976

Related U.S. Application Data

[63] Continuation of Ser. No. 278,304, Aug. 9, 1972, abandoned.

[51] Int. Cl.[2] ..... C23C 1/02

[52] U.S. Cl. ..... 427/320; 427/321; 427/432; 427/433; 427/434 D

[58] Field of Search ..... 427/321, 432, 433, 320, 427/434 D

[56] References Cited

U.S. PATENT DOCUMENTS

| | | | |
|---|---|---|---|
| 2,110,893 | 3/1938 | Sendzimir | 427/433 X |
| 2,570,906 | 10/1951 | Alferieff | 427/433 X |
| 3,027,269 | 3/1962 | Teshima et al. | 427/310 |
| 3,051,587 | 8/1962 | Coburn | 427/310 |
| 3,227,577 | 1/1966 | Baessler et al. | 427/433 X |
| 3,343,930 | 9/1967 | Borzillo et al. | 29/196.2 |
| 3,726,705 | 4/1973 | Carter et al. | 427/433 X |
| 3,728,144 | 4/1973 | Van Poucke | 427/433 X |

*Primary Examiner*—Ralph S. Kendall

*Attorney, Agent, or Firm*—Joseph J. O'Keefe; William B. Noll

[57] ABSTRACT

This invention relates to a method of hot-dip coating a ferrous strand. The strand is passed through a furnace in which the strand is heated, passed through a second furnace in which the strand is subjected to a reducing atmosphere and then passed through a protective hood and into the molten bath of aluminum-zinc alloy. A preheated reducing gas is introduced into the protective hood so as to sweep across and cover the surface of the molten bath within such hood prior to passing upwardly through it and the second furnace countercurrent to the movement of the strand. The preheated reducing gas has a temperature of at least 750° F, a dew point no greater then 0° F and is composed of at least 20% by volume of hydrogen, balance essentially nitrogen.

8 Claims, 1 Drawing Figure

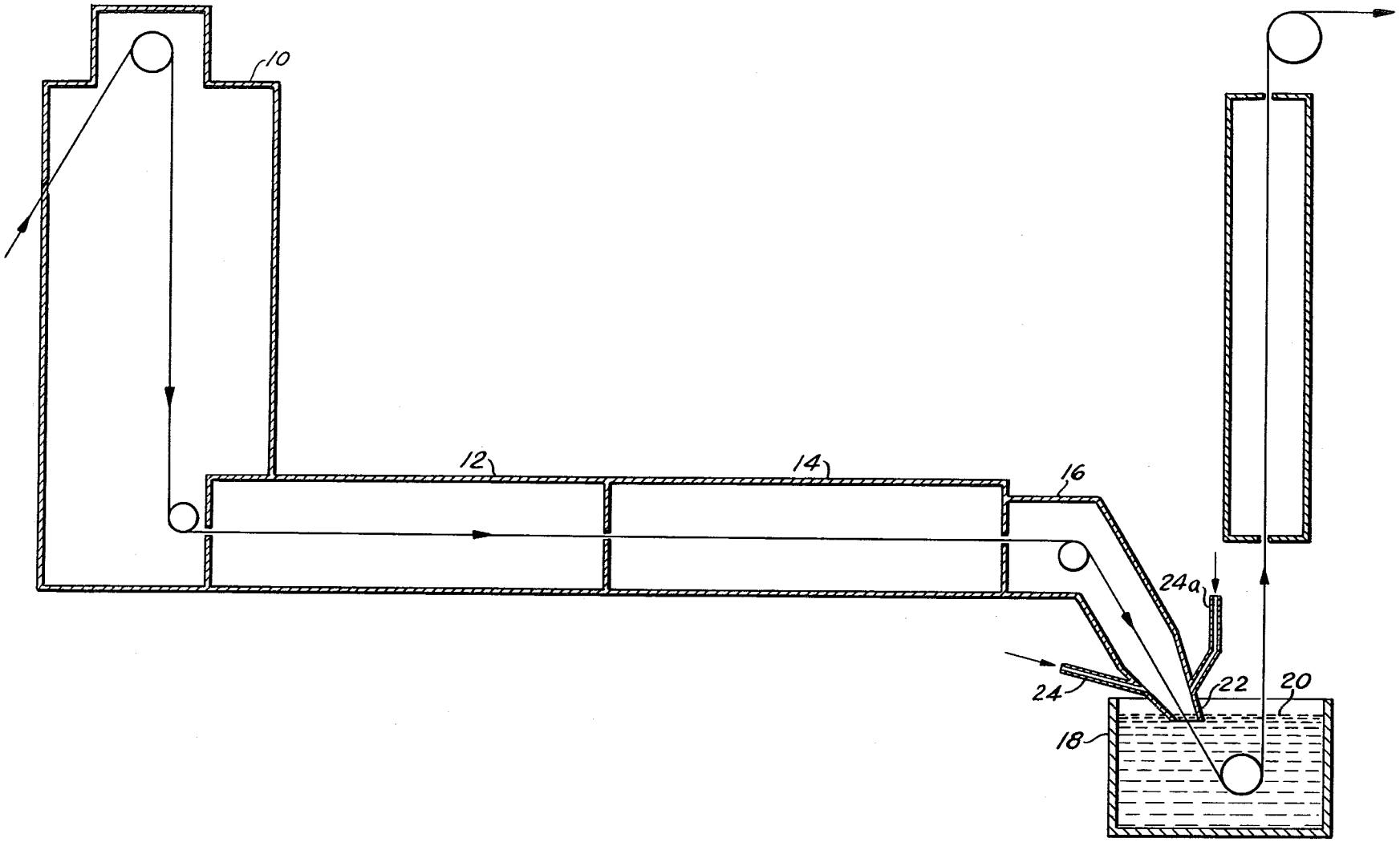
10
12
14
16
18
20
22
24a
24

METHOD OF TREATING FERROUS STRAND FOR COATING WITH ALUMINUM-ZINC ALLOYS

RELATED APPLICATION

This application is a continuation of Ser. No. 278,304, filed Aug. 9, 1972, now abandoned and entitled, "Method of Treating Ferrous Strand by Hot Dip Coating Procedure."

BACKGROUND OF THE INVENTION

This invention relates generally to a method of treating a ferrous strand, such as continuous strip or wire, and controlling the coating conditions to eliminate coating defects such as pinhole and bare spots, prior to the entry of said strand into a molten pot of an aluminum-zinc alloy. Thus, while this invention is applicable to the treatment of strip and wire, the more observable results are seen in the production of a continuous strip. Accordingly, the further description shall be directed to the treatment of such a strip. However, this should not be read as a limitation on the invention.

Ferrous articles coated with a metallic layer of nonferrous metal have long been utilized in mildly corrosive environments to great advantage. Typically, structural stability comes from the ferrous core while the coating affords resistance to corrosive attack. Optimum resistance is achieved where the protective layer is uniform and continuous. From this it would follow that a clean ferrous strip and effective coating conditions are essential for optimum corrosion resistance.

The prior art, particularly in the hot dip coating of aluminum on steel, early recognized the need to provide a clean, essentially oxide-free, strip prior to its entry into the molten bath. The aluminum would not adhere where oxide was present on the surface; hence, bare spots appeared. Further, bath surface oxidation at the point of entry for the strip has resulted in the defects enumerated. Elaborate procedures were devised in an attempt to avoid these undesirable results. Unfortunately they were not always effective, for even the slightest amount of moisture at the point of strip entry into the bath resulted in bare spots and/or pin holes, evidencing the presence of surface oxide.

The patent to Coburn, U.S. Pat. No. 3,051,587, represents one such attempt by the prior art. The patentee teaches a procedure for entraining the ferrous strip, just prior to its entry into the molten aluminum bath, in an atmosphere of sodium as a means to scavenge oxygen and water vapor in the strip entry snout. Teshima et al., U.S. Pat. No. 3,027,269, proposed to solve the problem of voids and pin holes with the application of a thin layer of an aqueous solution consisting of an alkali metal compound to the ferrous strip, drying in situ, and subjecting the thus coated strip to a reducing atmosphere prior to immersing in a bath of aluminum.

However, neither of these procedures were totally effective. Due to the very strong affinity of aluminum for oxygen, even the most minute quantities of oxygen or water vapor affected at least the bath surface, and the strip passing therethrough.

By the system of the present invention, an effective means is taught for the production of a ferrous strand having on its surfaces a uniform coating of about 25% to 70%, by weight, aluminum, balance essentially zinc, free of pin hole and bare spot defects.

SUMMARY OF THE INVENTION

In the practice of this invention an improved operating procedure has been taught to produce an aluminum or aluminum-zinc coated ferrous strand free of pin hole and bare spot defects. While generally such defects may result from unreduced oxides remaining on the ferrous strand, the most difficulty arose in attempting to avoid oxidation of the bath surface at the point of strand entry into the said bath. Even the presence of the most minute quantities of oxygen or water vapor were troublesome.

The present invention confronted and overcame the said problem by bathing the bath entering ferrous strand in a countercurrent flowing, heated, dry reducing gas. Specifically a reducing gas comprising at least 20%, preferably at least 28%, by volume hydrogen, balance nitrogen with a dewpoint no greater than about 0° F., preferably no greater than −4° F., is heated to a temperature above about 750° F., preferably between about 900–1150° F. and introduced into the bath submerged strip entry snout or protective hood to flow over the bath exposed therein and then countercurrent to the moving ferrous strip, where it essentially flows back into the annealing furnace and is exhausted, burned or recycled.

BRIEF DESCRIPTION OF DRAWING

The FIGURE is a simplified partial hot-dip coating line utilizing the strip treatment and coating controls of this invention.

DESCRIPTION OF PREFERRED EMBODIMENT

A typical hot-dip coating procedure that has been practiced for years is outlined, for example in U.S. Pat. No. 2,110,893, to T. Sendzimir. In this process, the ferrous strip is first passed through an oxidizing furnace to burn off surface oils, etc. and to receive a thin uniform layer of oxides on the surface. The strip is then passed through a reducing furnace to reduce said oxides and leave the surface clean to receive the coating of molten metal. From the said furnace the strip is caused to pass through a protective zone or snout, under a neutral or reducing atmosphere, into the molten coating bath. The snout generally dips into the bath so that at no time is the strip exposed to the atmosphere, at least between the reducing furnace and coating.

Since the introduction of the Sendzimir system of galvanizing steel, various improvements and modifications have been made. For example, annealing furnaces have been installed in combination with or as an alternative to the strip oxidation stage. However, in all cases, the more limited aspects of the coating itself have remained essentially the same. It is in this particular area that this invention is directed.

Referring now in greater detail to the coating procedure, and more particularly to the invention, with reference to the FIGURE, it will be observed that an uncoated ferrous strip is first withdrawn from a payoff reel (not shown) and introduced into an annealing furnace 10. From here the strip passes through a holding zone 12 and finally into the cooling portion 14 where the temperature of the strip is reduced to a temperature no greater than about that of the molten bath. For example, in an aluminizing operation, as known in the art, the strip temperature would be about 1200° F. In a 25–70 Al, balance Zn operation, the strip temperature would vary between about 900° to 1200° F.

From the cooling portion 14, the strip passes immediately into protective hood 16, and from there into the pot 18, containing the molten aluminum-zinc alloy 20. Typically, the strip remains in the molten bath from about 3 to 8 seconds to emerge for subsequent treatment, such as rapid or slow cooling, heating, or a sequential combination of such. In any event, such subsequent treatment forms no part of this invention, but is presented to merely provide background and understanding for the invention.

As shown in the FIGURE, the exit end 22 of the protective hood 16 extends below the surface of the molten bath so as to protect the strip from exposure to the atmosphere. Into the said hood 16, a dry reducing gas comprising at least 20%, preferably at least 28%, by volume hydrogen, balance nitrogen, with a dewpoint no greater than about 0° F., preferably no greater than −4° F., is introduced through conduits **24, 24*a*. However, prior to the gas's introduction into the protective hood, the gas is heated to a temperature above about 750° F., preferably between about 900° to about 1150° F. While a specific method of heating the gas has not been shown, it should be understood that independent means may be provided, or the gas may be circulated through a pipe loop located within the annealing furnace 10**.

Since bath oxidation within the protective hood 16 appears to be the major source of problems with aluminum-zinc alloy coatings, the conduits **24, 24*a* are arranged near the submerged end 22 such that the entering heated gas is caused to first sweep across the bath surface and then flow countercurrent to the strip movement into the annealing furnace 10. From here the gas may be exhausted, burned, or recirculated for further use. The rate of gas flow into the protective hood 16** is geared to the capacity of the enclosures from the said hood to the annealing furnace, such that a complete volume change occurs every 30 to 60 minutes.

While not desiring to be bound by any theory, it was discovered that molten baths containing significant quantities of aluminum were highly susceptible to the effects of minute amounts of oxygen on the order of 10–15 ppm, and water vapor of 1 part/thousand caused oxidation of the bath resulting in pin hole and bare spot defects on the coated strip. Conventional means were unable to overcome the problem. However, with the introduction of the heated gas, an answer was found. It was theorized that a warm or relatively cold reducing gas, introduced near the bath surface within the protective head had a chilling effect on the hood. It was further theorized that by chilling the hood portion adjacent the otherwise hot submerged portion, maintained at a bath temperature of about 1000° F., a rapid condensation and oxidation of the bath resulted from the presence of the minute quantities of oxygen and water vapor. In any case, the procedure of this invention teaches a method of controlling bath surface oxidation inside the protective hood to avoid bath oxide particle pickup on the strip and subsequent formation of pin hole and bare spot defects.

It will be appreciated from the preceding that several controls have been imposed on the reducing gas sweeping across the molten bath inside the protective hood, namely relative temperature, composition and dewpoint. Criticality of certain of these conditions are illustrated in Tables I and II.

Table I

| | | Protective Hood Gas Atmosphere | | |
|---|---|---|---|---|
| Sample | Strip Condition | Dew Point, ° F. | % $H_2$ bal. $N_2$ | Flow Rate |
| 1 | Bare spots | 3 to 11° F. | 4 to 11% | 1500 CFH |
| 2 | Bare spots | −13 to 2° F. | 7 to 16% | 50 to 300 CFH |
| 3 | Bare spots | −1 to 23° F. | 19 to 60% | 2650 CFH |
| 4 | Bare spots | −36 to 22° F. | 20 to 35% | 400 to 900 CFH |
| 5 | Bare spots | −35 to 16° F. | 28 to 29% | 850 to 1000 CFH |
| 6 | No Bare Spots | −25 to 12° F. | 30 to 42% | 850 to 1000 CFH |
| 7 | No Bare Spots | −40 to −38° F. | 35 to 46% | 850 to 1000 CFH |

Table II

| | | Protective Hood Gas Atmosphere | | |
|---|---|---|---|---|
| Sample | Strip Condition | Dew Point, ° F. | % $H_2$ bal. $N_2$ | Flow Rate |
| 8 | Bare spots | 6 to 33° F. | 43 to 64% | 2450 to 2550 CFH |
| 9 | No Bare Spots | −33 to −22° F. | 48 to 50% | 2250 CFH |
| 10 | No Bare Spots | −9° F. | 50% | 1550 CFH |
| 11 | No Bare Spots | −42 to −36° F. | 50% | 2300 to 2350 CFH |
| 12 | No Bare Spots | −56 to −12° F. | 56 to 65% | 950 to 1000 CFH |
| 13 | No Bare Spots | −40 to −38° F. | 40 to 56% | 400 to 900 CFH |
| 14 | No Bare Spots | −9 to −3° F. | 67 to 70% | 2700 CFH |

It is interesting to note that there is basically a direct relationship between dew point and hydrogen content. For example, with 50% hydrogen, a relatively high dew point of −9° F. gave satisfactory results. But, as the hydrogen was reduced to about 30%, it became necessary to lower the dew point to at least −12° F. Sample 14, with a hydrogen level of 70%, showed no bare spots with only a dew point of −3° F. Accordingly, it could be concluded that with even greater amounts of hydrogen, i.e., up to 100%, higher dew points of about 0° F. could be tolerated. However, on the low side, for practical considerations, the hydrogen should be present in an amount of at least 20% by volume, balance nitrogen.

EXAMPLE

To further demonstrate the effectiveness of this invention on the production of ferrous articles having a coating containing at least 25% by weight aluminum, balance essentially zinc, a series of 13 steel coils were subjected to a hot-dip coating process under the conditions summarized below. The composition of the several coils fell within the following limits:

Carbon:0.024 to 0.057%
Manganese:0.27 to 0.37%

Phosphorus:0.029% max.
Sulfur:0.029% max.
Silicon:0.01% max.
Aluminum (Sol.):0.004% max.
Nitrogen (Sol.):0.004% max.
Iron:balance.

Each of said coils were run at a speed of about 200 fpm through the preliminary stages, into a protective hood and molten metal bath, the average composition of which was about 54% aluminum, 44% zinc, 1.3% silicon, balance iron with less than 0.01% lead, all percentages being by weight. Into the protective hood a reducing gas, heated from about 85° F. up to 990° F. prior to its introduction, comprising 30% $H_2$, balance essentially nitrogen — dew point —45° to —30° F. with flow rates varying between 15,000 to 24,000 CFH, was caused to sweep across the molten metal bath within the protective hood. After solidification of the aluminum-zinc coating, no observable bare spots were detected.

Since variations may be made from the optimum conditions set forth above in the EXAMPLE, particularly after reading the preceding specifications, no limitation is intended to be imposed on this invention except as set forth in the appended claims.

We claim:

1. A method of coating a ferrous strand with an alloy coating comprising, by weight, about 25 to 70% aluminum, balance essentially zinc, wherein said ferrous strand is caused to move from a heating furnace through a protective hood into a molten metal bath composed of said aluminum-zinc alloy, into which said protective hood extends in a manner to enclose a small portion of the surface of said molten metal bath within said protective hood, comprising the steps of:

a. introducing into said protective hood a reducing gas preheated to a temperature of at least about 750° F. and composed of at least 20% by volume of hydrogen, balance essentially nitrogen, said reducing gas having a dew point no greater than about 0° F. and being introduced in such a manner as to sweep across the surface of the molten metal bath, b. correlating the hydrogen content of said reducing gas with the dew point thereof so as to control bath surface oxidation within said protective hood to avoid bath oxide particle pickup on the strand, and c. continuing to introduce such correlated preheated reducing gas into said protective hood and causing said reducing gas to flow countercurrent to the movement of the ferrous strand, whereby to bathe and maintain said strand within said protective hood and heating furnace under reducing conditions.

2. The method as claimed in claim 1 wherein said gas is heated prior to its introduction into said protective hood to a temperature between about 900° to about 1150° F.

3. The method as claimed in claim 1 wherein said dew point is no greater than −4° F.

4. The method as claimed in claim 3 wherein said gas is heated prior to its introduction into said protective hood to a temperature between about 900° to about 1150° F.

5. The method as claimed in claim 3 wherein the hydrogen content of said reducing gas comprises at least 28%.

6. The method as claimed in claim 5 wherein said gas is heated prior to is introduction into said protective hood to a temperature between about 900° to about 1150° F.

7. The method as claimed in claim 1 wherein said dew point is no greater than about −12° F.

8. The method as claimed in claim 7 wherein the hydrogen content of said reducing gas comprises at least 28%.

* * * * *